United States Patent [19]

Nakao et al.

[11] Patent Number: 4,676,466

[45] Date of Patent: Jun. 30, 1987

[54] COLLAPSIBLE BODY SUPPORT STRUCTURE

[75] Inventors: Shinroku Nakao, Kanagawa; Yoshiyasu Ishii; Hiroaki Matsuda, both of Tokyo, all of Japan

[73] Assignee: Combi Co., Ltd., Tokyo, Japan

[21] Appl. No.: 728,572

[22] Filed: Apr. 29, 1985

[30] Foreign Application Priority Data

Apr. 27, 1984 [JP] Japan ..... 59-62583[U]
May 23, 1984 [JP] Japan ..... 59-75495[U]

[51] Int. Cl.[4] ..... F16M 11/38

[52] U.S. Cl. ..... 248/166; 248/188.6; 403/95; 403/330; 224/160; 16/333; 16/347

[58] Field of Search ..... 248/166, 439, 188.6; 297/45, 55; 403/95, 330; 224/158, 159, 160; 16/333, 347

[56] References Cited

U.S. PATENT DOCUMENTS

| | | | |
|---|---|---|---|
| 2,822,117 | 2/1958 | Mack | 224/161 |
| 2,827,255 | 3/1958 | Kampa | 248/289.1 X |
| 4,044,931 | 8/1977 | Catelli | 297/55 X |
| 4,386,790 | 6/1983 | Kassai | 297/45 X |
| 4,428,598 | 1/1984 | Kassai | 297/45 X |

FOREIGN PATENT DOCUMENTS

| | | | |
|---|---|---|---|
| 531717 | 10/1956 | Canada | 16/333 |

*Primary Examiner*—Robert W. Gibson, Jr.
*Assistant Examiner*—Blair M. Johnson
*Attorney, Agent, or Firm*—Finnegan, Henderson, Farabow, Garrett and Dunner

[57] ABSTRACT

A collapsible body support structure is provided having a pair of parallel support legs, a transverse bar and a substantially U-shaped carrier frame. The transverse bar contains at least two bar sections pivotally connected together. The transverse also includes end portions, which are secured to the support legs. The substantially U-shaped carrier frame includes a bight arm formed of at least two carrier sections which are pivotally connected together and have a pair of parallel arms. The parallel support legs have end portions. Pivot supports are pivotally mounted on the upper end portions of the support legs for pivotal movement of the carrier frame between the stored position adjacent to the support legs and an extended position. Spring-biased stopper plates are pivotally connected to the support legs for retaining the carrier frame in the extended position.

6 Claims, 9 Drawing Figures

COLLAPSIBLE BODY SUPPORT STRUCTURE

BACKGROUND OF INVENTION

The present invention relates to a collapsible body support structure and, more particularly, to a carrying apparatus for a baby which can be collapsed to optimize utility. The carrying apparatus includes shoulder straps but may also be supported on a planar surface.

Conventional baby carriers are typically in the form of a pack frame having a substantially parallel L-shaped arrangement rods which are either aluminum or some other light metal. The upper parallel rods are support frames for suspending a hammock, sack, or the like. Another pair of rods depend from the upper parallel rods and constitute a backrest. Center straps provide support and interconnect the rods forming the backrest to maintain the parallel construction of the rods. Such conventional baby carriers are designed to provide a suspension structure for a hammock and are generally capable of being collapsed. To make the baby carrier collapsible or foldable, the carrier is simply arranged so that the parallel rods for suspending the hammock and the backrest rods are drawn together in parallel, thereby folding the L-shaped configuration in a planar state. Thus, such conventional devices fail to account for the angular configuration of the support rods, thereby limiting the compact nature of the structure.

SUMMARY OF THE INVENTION

Accordingly, it is an object of the invention to provide an effective baby carrier which is simple in operation and which collapses into a compact structure for transportation or storage.

It is also an object of the invention to provide a baby carrier which is lightweight and which collapses into a portable configuration, such as a bracket, a U-shape, a quadrangle, or a flat form.

Additional objects and advantages of the present invention will be set forth in part in the description that follows and in part will be obvious from the description or may be learned by practice of the invention. The objects and advantages of the invention may be realized and obtained by the apparatus particularly pointed out in the appended claims.

To achieve the objects in accordance with the purpose of the invention, as embodied and as broadly described herein, a collapsible body support structure includes a pair of parallel support legs, a transverse bar and a substantially U-shaped carrier frame. The transverse bar contains at least two bar sections pivotally connected together. The transverse bar also includes end portions, which are secured to the support legs. The substantially U-shaped carrier frame includes a bight arm formed of at least two carrier sections, which are pivotally connected together and have a pair of parallel arms. The parallel support legs have end portions. Pivot support means are pivotally mounted on the end portions of the support legs and connected to opposite ends of the carrier frame for pivotally mounting the carrier frame between a stored position adjacent to the support legs and an extended position.

Also according to the present invention, the collapsible body support structure may include a substantially U-shaped base frame formed of at least two frame members pivotally connected together and a pair of base plate means secured to the support legs for pivotally supporting the base frame. Further, the pivot support means may include housings rigidly attached to the end portions of the carrier frame. The housings have means for pivotally supporting the carrier frame relative to the support legs. Means may also be provided for retaining the carrier frame in the extended position. The retaining means include a stopper plate and spring means. The stopper plate is pivoted at first ends to each of the support legs. The spring means are attached to the stopper plate in the housing for biasing the carrier frame in the extended position.

Further, in accordance with the present invention, ball pivots may be used which are connected between the bar sections, the carrier sections, and the frame sections enabling joint pivotal movement of each of the sections between a collapsed and an operational state. Folding rods may be positioned between a pair of the ball pivots connected between each of the bar sections, the carrier sections and the frame sections. Projections are formed on the carrier sections, the bar sections, the frame sections and the folding rods. Further, cutouts are formed on the carrier sections, the bar sections, the frame sections and the folding rods for receiving the projections when the support structure is positioned in the operational state.

The accompanying drawings, which are incorporated and constitute part of this specification, illustrate an embodiment of the invention, and together with the description, serve to explain the principles of the invention.

DESCRIPTION OF THE PREFERRED EMBODIMENT

Reference will now be made in detail to a presently preferred embodient of the invention, an example of which is illustrated in the accompanying drawings.

Figure 1:
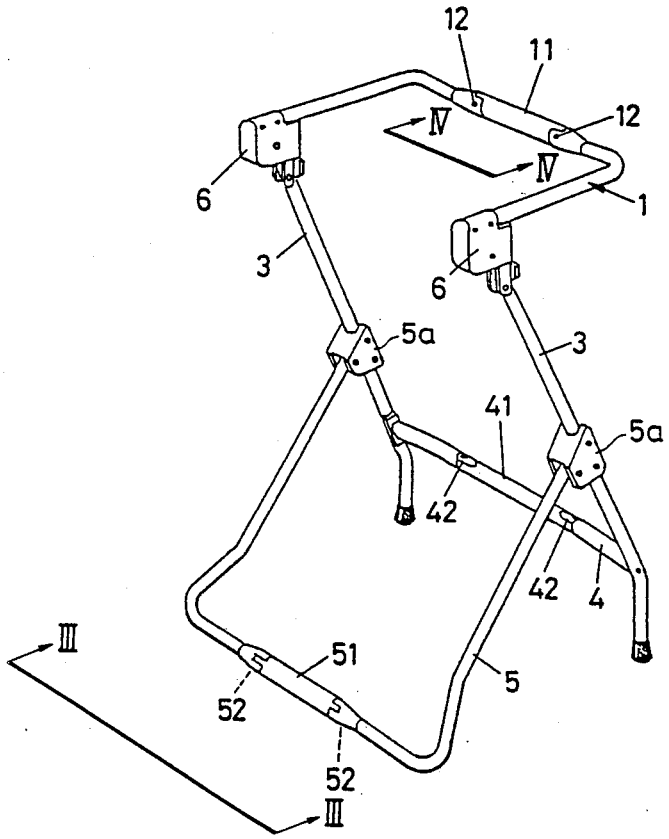
FIG. 1 is a perspective view of the collapsible body support structure of the present invention, in which the baby sack or bag is removed.
Figure 6:
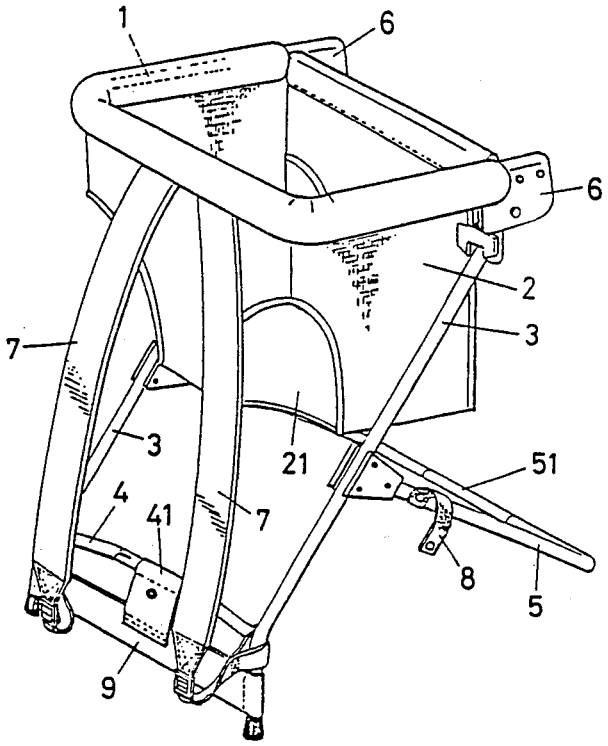
FIG. 6 is a perspective view of a collapsible body support structure supporting a sack or bag.

As viewed together in FIGS. 1 and 6, it may be seen that the collapsible body support structure contains a suspended body sack for supporting a young child. The present invention also includes shoulder straps and a waist strap to accomodate the collapsible body support structure for portable use.

As embodied herein, reference number 1 designates a substantially U-shaped carrier frame for suspending a body sack, such as a hammock or bag 2. The carrier frame 1 preferably includes a light arm formed of a pair of carrier sections which are separately connected to the upper ends of an opposing pair of parallel support legs 3. The collapsible support structure includes transverse bar 4 preferably having a pair of bar sections secured to the support legs 3, thereby forming an H-shaped configuration. The transverse bar 4 extends between the lower ends of the parallel support legs 3. As shown in FIG. 6, shoulder straps 7 are attached between the carrier frame 1 and the support legs 3 for portable use of the support structure. A waist band 9 is provided adjacent to and substantially in parallel with the transverse bar 4.

In accordance with the invention, a substantially U-shaped base frames 5 is formed having at least two frames sections pivotally connected together. Preferably, the base frame 5 is pivotally attached to a base plate 5*a* secured to the support legs 3. Retention straps 8 are provided on the base frame 5 to secure the base frame 5 to the support legs 3 in the collapsed state.

Figure 3:
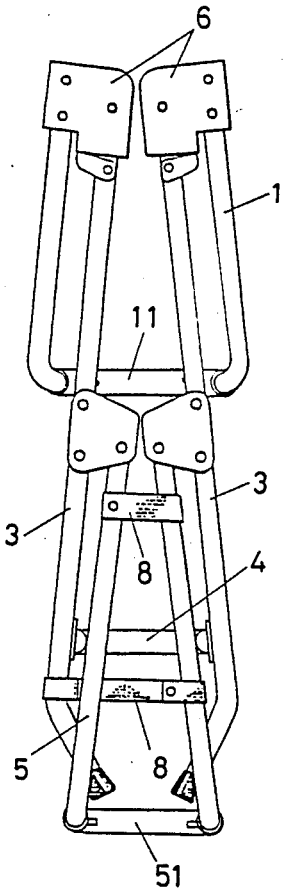
FIG. 3 is a front view of the collapsible body support structure in the collapsed state looking in the direction of arrows III—III in FIG. 1.
Figure 4:
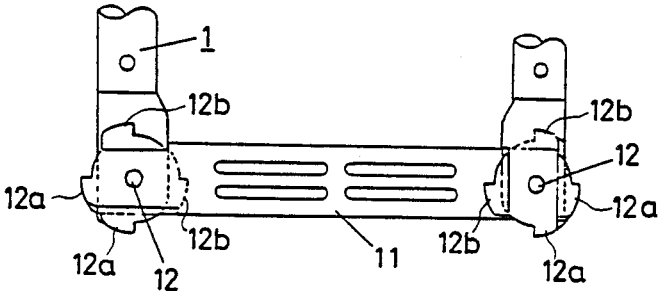
FIG. 4 is an enlarged plan view showing the pivotably connected carrier sections looking in the direction of arrows IV—IV of FIG. 1.

In accordance with the invention, ball pivots and folding rods may be provided to pivot the transverse bar means, the carrier frame and the base frame together to collapse the support structure. As embodied herein and as viewed together in FIGS. 1–5, ball pivots 12, 42 and 52 and folding rods 11, 41 and 51 are attached to the carrier frame 1, transverse bar 4 and base frame 5, respectively. As shown in FIG. 4, the folding rod 11 is pivotally connected between the carrier sections of carrier frame 1 by the ball pivots 12. Folding rods 41 and 51 are similarly connected between the bar sections of the transverse bar 4 and the frame sections of base frame 5, respectively.

Therefore, two ball pivots may be used to provide a collapsible body support structure having a U-shape, as shown on FIG. 4, or V-shape, if only one ball pivot is provided. Nevertheless, the number ball pivots 12, 42 and 52 for pivotally collapsing the carrier frame 1, the transverse bar 4 and the base frame 5 must be the same to provide a cooperating collapsible structure. That is, if the carrier frame 1 is collapsed in the U-shape, as shown in FIG. 4, the transverse bar 4 and the base frame 5 must have the same U-shape configuration.

Figure 5:
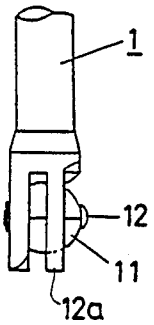
FIG. 5 is a side view of FIG. 4.

As embodied herein and shown in FIGS. 4 and 5, the carrier frame 1 and folding member 11 include projections 12*a* and cut outs 12*b*, which correspond in shape. When the support structure is extended and operational, the projections 12*a* on the carrier frame are positioned within the cut outs 12*b* of the folding bar 11, while the projections 12*a* on the folding bar are positioned within the cut outs 12*b* of the carrier frame 1. The transverse bar 4 and folding member 41 include projections 42*a* and cut outs 42*b*. Similarly, the base frame 5 and folding member 51 include projections 52*a* and cut outs 52*b*. Therefore the projections 12*a*, 42*a* and 52*a* are pivoted to be within the cut outs 12*b*, 42*b* and 52*b*, respectively, when the support structure is operational, whereas the projections 12*a*, 42*a* and 52*a* are pivoted out of engagement with their respective cut outs 12*b*, 42*b* and 52*b*, when the support structure is collapsed.

Figure 8:
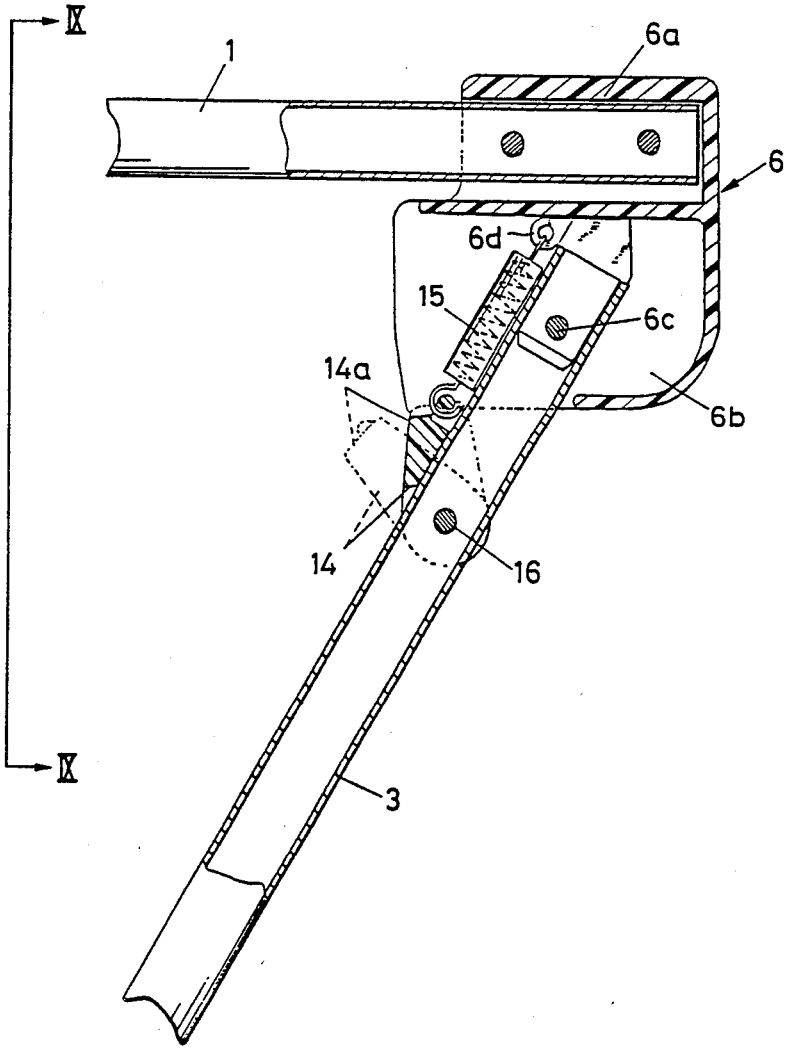
FIG. 8 is an enlarged partial section of the pivot support means shown in FIG. 7.
Figure 9:
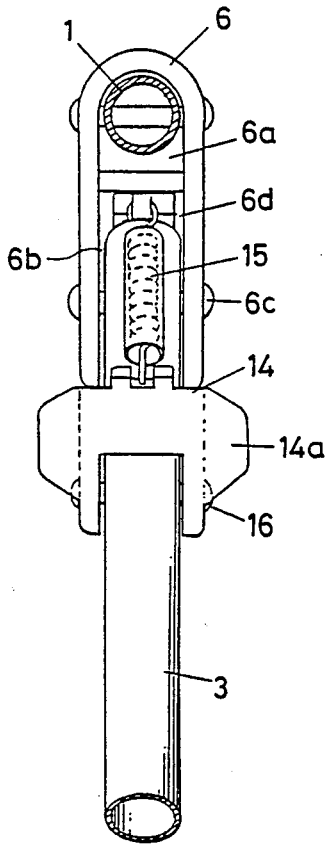
FIG. 9 is an elevational view of the pivot support means looking in the direction of arrows IX—IX of FIG. 8.

In accordance with the present invention, pivot support means are pivotally mounted on the upper ends of the support legs and rigidly connected to opposite ends of the carrier frame for pivotal movement of the carrier frame between a stored position adjacent to support legs and and extended position. As embodied herein and shown in FIGS. 7–9, the pivot support means includes a pair of housings 6 secured to opposite ends of the carrier frame 1 to provide pivotal movement of the carrier frame 1 relative to the support legs 3. The housings 6 include mounting chamber 6*a*, pivot chamber 6*b* and pivot member 6*c*. The carrier frame 1 is positioned within the mounting chamber 6*a* and the upper end of the support leg 3 is positioned within the pivot chamber 6*b* of the housing 6. The pivot members 6*c* pivotally attach housings 6 to the support leg 3. The housings 6 are preferably molded from hard synthetic resin or the like.

Figure 7:
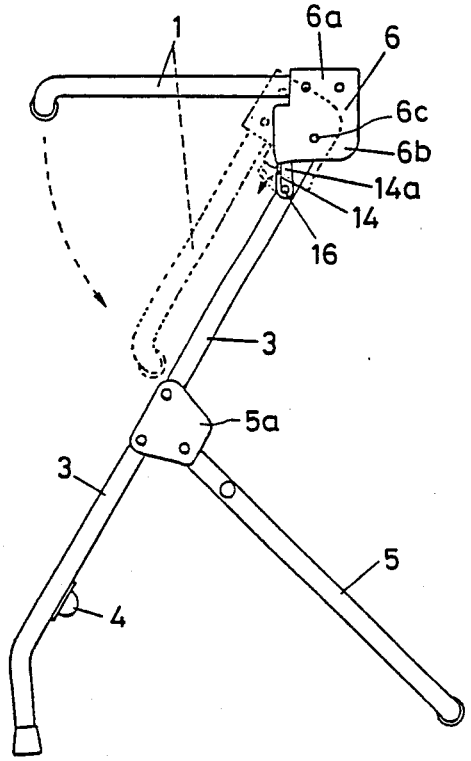
FIG. 7 is a side view of the present invention showing the steps of folding the carrier frame from the extended and stored position, which is represented by dashed lines.

In accordance with the invention, the collapsible body support structure includes means for retaining the carrier frame in the extended position. As embodied herein and shown in FIGS. 7–9, retaining means includes stopper plate 14 and spring 15. The stopper plate 14 is pivotally mounted by a pivot pin 16 at one end of the support leg 3. The spring 15 is attached between the free end of the stopper plate 14 and a ring member 6*d* depending from the housing 6. The stopper plate 14 preferably includes wing surfaces 14*a* which abut the base of the housing 6 and the support leg 3, and which also facilitate rotation of the stopper plate 14. Counterclockwise rotation of the stopper plate as shown in FIG. 7 enables the carrier frame 1 to be aligned substantially in parallel with the support legs 3, whereas clockwise rotation of the stopper plate 14 corresponds to the normal bias of the spring 15, so that the carrier frame 1 will return to the extended position. Thus, the stopper plate 14 abuts the support leg 3 when the carrier frame 1 is extended.

Figure 2:
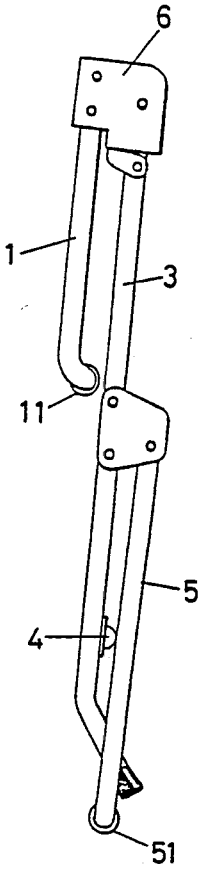
FIG. 2 is a side view of the collapsible body support structure in the collapsed state.

In summary, to collapse the support structure, the stopper, plates 14 are released from engagement with housing 6 and pivoted about pivot pin 16 against the normal bias of the spring 15, thereby pivoting the housing 6 and the carrier frame 1 about the pivot member 6*c*. The base frame 5 is also pivotable toward support legs 3 to provide a substantially planar structure as depicted in FIG. 2. Further, the ball pivots 12, 42 and 52 and folding rods 11, 41 and 51 on the carrier frame 1, the transverse bar 4 and the base frame 5 allow the support legs 3 to be brought together, as shown in FIG. 3. Thus, compact storage of the collapsible body support structure is possible.

The support structure is placed in operable condition as shown in FIG. 6 by simply reversing the series of steps used to collapse the structure. The ball pivots 12, 42 and 52 are pivoted until the projections 12*a*, 42*a* and 52*b* are engaged within the cut outs 12*b*, 42*b* and 52*b*, thus expanding the transverse separation between the support legs 3. The carrier frame 1 is raised, and then the stopper plate 14 is moved toward the housing 6 by means of spring 15 to able the stopper plate 14 to abut the base of the housing 6 and to secure the carrier frame 1 in the extended position. The base frame 5 is also pivoted away from the support legs 3.

It will be apparent to those skilled in the art that modifications and variations can be made in the collapsible body support structure of this invention. The invention in its broader aspects is, therefore, not limited to the specific details, representative method and apparatus, and illustrative examples shown and described. Thus, it is intended that all matter contained in the foregoing description or shown in the accompanying drawings shall be interpreted as illustrative and not in a limiting sense.

What is claimed is:

1. A collapsible body support structure, comprising:

a. a pair of parallel support legs each having an upper end;

b. a transverse bar having at least two bar sections pivotally connected together and having two end portions each secured to one of said support legs;

c. a substantially U-shaped carrier frame having a bight arm formed of at least two carrier sections pivotally connected together;

d. a pair of pivot housings pivotally mounted on said upper ends of said support legs and connected to opposite ends of said carrier frame for pivotally mounting said carrier frame between a stored position adjacent said support legs and an extended position; and e. locking means, mounted on said support legs and cooperating with said pivot housings, for locking said carrier frame in the extended position, said locking means including:

stopper plates having first ends pivotally attached to said support legs and second ends engageable with said pivot housings when said carrier frame is in the extended position to lock said carrier frame in the extended position, and spring means attached to said stopper plate and said pivot housing for biasing said stopper plate in engagement with said pivot housing when said carrier frame is in the extended position.

2. The collapsible body support structure defined in claim 1, further comprising:

a substantially U-shaped base frame formed of at least two frame sections pivotally connected together; and a pair of base plate means secured to said support legs for pivotally supporting said base frame.

3. The collapsible body support structure as defined in claim 2, wherein:

said transverse bar includes at least one ball pivot pivotally connecting said bar sections together;

said carrier frame includes at least one ball pivot pivotally connecting said carrier sections together; and said base frame includes at least one ball pivot pivotally connecting said frame sections together.

4. The collapsible body support structure as defined in claim 2, wherein:

said transverse bar includes a first folding rod with two ends and a ball pivot pivotally connecting each end of said first folding rod to one of said bar sections;

said carrier frame includes a second folding rod with two ends and a ball pivot pivotally connecting each end of said second folding rod to one of said carrier sections; and said base frame includes a third folding rod with two ends and a ball pivot pivotally connecting each end of said third folding rod to one of said frame sections.

5. The collapsible body support structure as defined in claim 4, wherein said bar sections, said frame sections and said folding rods each include at said ball pivots projections and cut outs for receiving said projections.

6. The collapsible body support structure as defined in claim 1, wherein each of said stopper plates includes a wing surface abutting said support leg when said stopper plate engages said pivot housing with said carrier frame in the extended position.

* * * * *